US006499246B1

(12) United States Patent
Zedrosser

(10) Patent No.: US 6,499,246 B1
(45) Date of Patent: Dec. 31, 2002

(54) FIREARM

(76) Inventor: Ulrich Zedrosser, Ortskai 34, A-4400 Steyr (AT)

( * ) Notice: Subject to any disclaimer, the term of this patent is extended or adjusted under 35 U.S.C. 154(b) by 0 days.

(21) Appl. No.: 09/674,883

(22) PCT Filed: May 21, 1999

(86) PCT No.: PCT/AT99/00129

§ 371 (c)(1),
(2), (4) Date: Nov. 7, 2000

(87) PCT Pub. No.: WO99/63295

PCT Pub. Date: Dec. 9, 1999

(30) Foreign Application Priority Data

May 29, 1998 (AT) ..... 922/98

(51) Int. Cl.[7] ..... F41A 21/00
(52) U.S. Cl. ..... 42/75.03
(58) Field of Search ..... 42/75.02, 75.03, 42/124, 126, 127, 111, 121

(56) References Cited

U.S. PATENT DOCUMENTS

| | | | | |
|---|---|---|---|---|
| 1,294,453 | A | * | 2/1919 | Hammond |
| 2,542,513 | A | * | 2/1951 | Hackett |
| 2,563,849 | A | * | 8/1951 | Lebherz |
| 2,583,260 | A | * | 1/1952 | Felix |
| 2,620,565 | A | * | 12/1952 | Boughton |
| 2,825,138 | A | * | 3/1958 | Ivy |
| 3,045,351 | A | * | 7/1962 | Dayton |
| 3,513,549 | A | * | 5/1970 | Smiley |
| 4,006,548 | A | * | 2/1977 | Vignini |
| 4,021,954 | A | * | 5/1977 | Crawford |
| 4,026,055 | A | * | 5/1977 | Weast |
| 4,429,468 | A | * | 2/1984 | Jimenez et al. |
| 4,729,186 | A | | 3/1988 | Rieger |
| 4,776,126 | A | * | 10/1988 | Williams |
| 4,779,370 | A | * | 10/1988 | Cormack |
| 5,522,166 | A | * | 6/1996 | Martel |
| 5,540,008 | A | * | 7/1996 | Kirnstatter |

FOREIGN PATENT DOCUMENTS

| | | | |
|---|---|---|---|
| DE | 2207555 | * | 8/1973 |
| FR | 2592149 | * | 6/1987 |
| GB | 540 826 | | 1/1941 |

* cited by examiner

*Primary Examiner*—Michael J. Carone
*Assistant Examiner*—Troy Chambers
(74) *Attorney, Agent, or Firm*—Collard & Roe, P.C.

(57) ABSTRACT

The description refers to a rifle with a shell (2) to be inserted into a shaft (1), to which shell (2) a barrel (3) can be connected, and with a mounting rail (5) fixed to the barrel (3) for accommodating an aiming telescope (17) projecting backward beyond the barrel (3). To achieve favorable construction. features, it is suggested that the mounting rail (5) for accommodating the aiming telescope (17) engages into a shell guide (6).

3 Claims, 2 Drawing Sheets

FIREARM

FIELD OF THE INVENTION

The invention relates to a rifle with a shell to be inserted into a shaft, to which a barrel can be connected, and with a mounting rail fixed at the barrel and projecting backward-beyond the barrel for accommodating an aiming telescope.

DESCRIPTION OF THE PRIOR ART

To be able to re-equip a rifle for various applications it is known to change the barrel according to the respective requirements. Such an exchange of barrel requires an accurate connection between the barrel and its accommodating shell, in which the closure and the trigger are borne. Moreover, it must be ensured that changes resulting in the area of the aiming device are avoided, otherwise the rifle will have to be tested again after each barrel exchange. This is especially difficult when aiming telescopes are used, as a sufficiently exact alignment of the aiming telescope against the barrel requires a fixed correlation of the aiming telescope with the barrel. However, if the receptacle of the aiming telescope is not, as usual, assigned to the shell, but to the barrel, the aiming telescope must be moved forward, whereby the use of the aiming telescope is affected. It is true that the conventional arrangement of the aiming telescope at the shell ensures a favorable position of the aiming telescope relative to the rifleman, however, testing the rifle after each barrel exchange cannot be avoided, if an adequate aiming accuracy is demanded. To avoid these drawbacks, it is also known (U.S. Pat. No. 4,779,370 A) to solder onto the barrel a mounting rail projecting backward beyond the barrel, for accommodating the aiming telescope. As this mounting rail is assigned to the barrel and extends over the closure area above the shell accommodating the barrel such that the latter is exchangeable, the aiming telescope can be brought close enough to the eye of the rifleman to favorably utilize the range of vision covered by the aiming telescope, without having to test the rifle again after each barrel exchange. The drawback of this known construction, however, lies in the fact that, because of the necessary radial distance between the barrel axis and the axis of the aiming telescope, and due to the occurring power of repulsion when firing the shot, there are considerable bending stresses acting upon the mounting rail, which, with an increasing length of the mounting rail, lead to vibrations that can be kept within acceptable limits only by adequadely reinforcing the mounting rail freely projecting backward. However, any reinforcement of the mounting rail implies an increase of weight, which should be avoided as far as possible.

SUMMARY OF THE INVENTION

The invention has therefore the objective to design a rifle with an exchangeable barrel in such a way that a fixed correlation of a mounting rail, projecting backward beyond the barrel and accommodating the aiming telescop, is ensured without having to expect repulsion-related vibration problems or to put up with an increase of weight.

The objective of the invention is achieved in that the mounting rail for accommodating the aiming telescope engages in a shell guide.

As the mounting rail engages in a shell guide, the receptacle for the aiming telescope can be provided in the shell area, as this is the case with rifles with non-exchangeable barrels. This means that the radial distance between the barrel axis and the axis of the aiming telescope that is relevant for the bending stresses in the mounting rail, can be sufficiently reduced to avoid higher bending moments. Additionally, via the shell guide of the mounting rail, an efficient attenuation of possibly occurring vibrations in the area of the mounting rail can be achieved, so that, via the shell guide for the mounting rail, a receptacle of the aiming telescope meeting all requirements is provided. In spite of the engagement of the mounting rail in the shell guide the shell proper remains largely free from the power of repulsion occurring when firing the shot and transmitted to the mounting rail, so that the use of light-weighted plastic shells becomes possible.

Particularly favorable construction features are achieved in that the mounting rail forms a sleeve accommodating the barrel end which, in a simple way, permits a rigid connection of the mounting rail with the barrel, without having to modify the barrel. The barrel end may be glued into-this sleeve of the mounting rail.

If the barrel is safely fastened in the sleeve of the mounting rail, a favorable connection facility for the barrel with the shell is provided additionally, if the sleeve is equipped with a fastening ridge projecting radially or on the side opposite the mounting rail and locked in the shell. As the sleeve can be inserted into the shell with positive fit via the fastening ridge, a favorable power transmission between the barrel and the shell is achieved after locking the fastening ridge in the shell, so that the barrel and the shell are exposed to comparatively low strains during shooting, thus providing for a very simple and inexpensive construction. After all, due to the provided power-reducing connection of the mounting rail at the barrel, the power transmission between the barrel and the aiming telescope does not constitute any strain neither for the shaft nor for the shell.

BRIEF DESCRIPTION OF THE DRAWING

The drawing depicts an example of the subject matter of the invention.

DESCRIPTION OF THE PREFERRED EMBODIMENT

Figure 1:
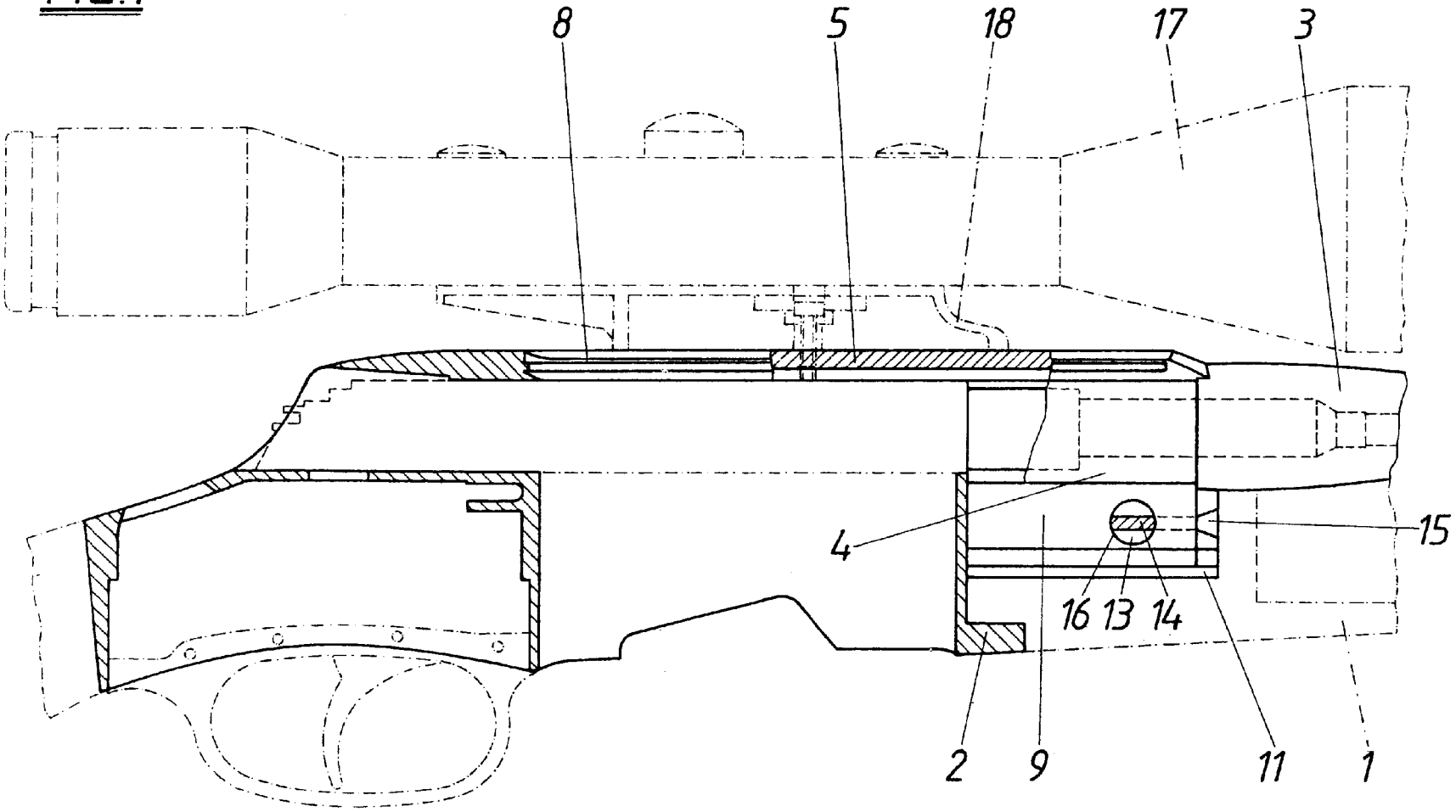
FIG. 1 shows the shell with the inserted barrel of a rifle according to the invention in a schematic longitudinal section.
Figure 2:
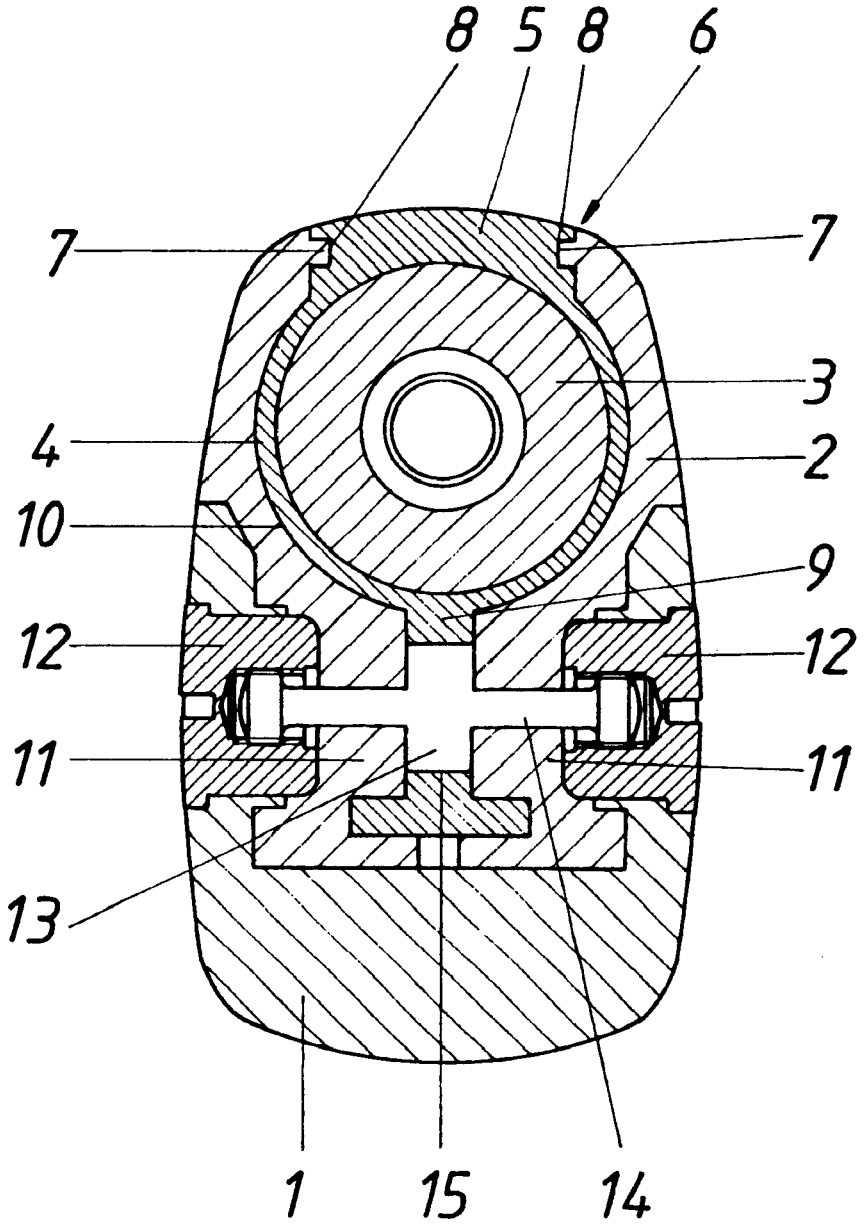
FIG. 2 is a section following the line II—II of FIG. 1 on a larger scale.

The shell 2 inserted into the shaft 1 is connected to an exchangeable barrel 3, the barrel end of which is glued into a sleeve 4 enclosing it. This sleeve 4 is connected in a single piece to the mounting rail 5, which projects backward beyond the sleeve 4 and engages into a shell guide 6. This shell guide 6 consists of an insert opening starting from the front face of the shell 2, with parallel guide bars 7 engaging into lateral guiding grooves 8 of the mounting rail 5, as can be inferred particularly from FIG. 2.

The sleeve 4 is provided with a fastening ridge 9 on the side opposite the mounting rail 5, via which the sleeve 4 with the barrel 3 glued in place is locked in the shell 2. As it is, the shell 2 forms an insert receptacle 10 between two cheeks 11 that is adapted to the shape of the sleeve 4 and of the fastening ridge 9, which cheeks 11 can be secured in place against each other by means of tightening nuts 12 cramping the sleeve 4 and the fastening ridge 9. To this end a tensioning pin 13 is inserted into the fastening ridge 9, which, by means of flattened sections 14, engages into the guiding slots 15 of the cheeks 11 of the shell 2 and puts through the fastening ridge 9 in a penetration opening 16. The sleeve 4 with the fastening ridge 9 and the inserted fastening bolt 13 can be inserted axially into the insert receptacle 10 between the cheeks 11 of the shell 2 down to the stop in a simple way, to be then cramped via the tightening nuts 12. The tightening nuts 12 engage into the end-side thread sections of the tensioning pin 13. As can be inferred from FIG. 2, the front part, too, of the shaft 1 can be connected to the shell 2 via the tightening nuts 12.

After positioning the barrel 3 in the shell 2 as described, the closure may be inserted into the shell 2 as usual, and the rifle may be loaded. As the mounting rail 5 for accommodating the aiming telescope 17 is rigidly connected with the barrel 3 via the sleeve 4, the receptacle 18 for the aiming telescope 17 to be provided on the mounting rail 5 is determined relative to the barrel 3, so that a barrel 3 once tested with the aiming telescope 17 can be exchanged, without having to be tested again after the exchange. After all, the position of the aiming telescope receptacle 18 relative to the barrel 3 is not altered when connecting the barrel 3 to the shell 2, so that tolerances unavoidable when changing the barrel do not affect the aiming accuracy. The mounting rail 5 projecting backward beyond the barrel 3 and fixedly assigned to the barrel 3 permits a favorable arrangement of the aiming telescope 17 in the shell area, with the shell guide 6 for the mounting rail 5 providing an additional alignment facility for the barrel 3 relative to the shell 2. Moreover, as the mounting rail 5 is guided in the shell 2, a comparatively small distance between the barrel axis and the axis of the aiming telescope 17 can be maintained, so that the repulsion-related bending forces on the mounting rail 5 that depend on this distance can also be kept low. Moreover, as the mounting rail 5 is supported in the shell guide 6, any bending vibrations are attenuated, which leads to a favorable and solid construction.

Due to the immediate power transmission between the barrel 3 and the aiming telescope 17 via the mounting rail 5 assigned to the barrel 3, construction benefits are achieved for rifles with non-exchangeable barrels, too, as in this case the shell 2 can be made, for instance, of plastic because of the lower strain.

What is claimed is:

1. Rifle with a shell (2) to be inserted into a shaft (1), to which shell (2) a barrel (3) can be connected, and with a mounting rail (5) fixed at the barrel (3) and projecting backward beyond the barrel (3) for accommodating an aiming telescope (17), characterised in that the mounting rail (5) for accommodating the aiming telescope (17) engages in a shell guide (6).

2. Rifle according to claim 1, characterised in that the mounting rail (5) forms a sleeve (4) accommodating the barrel end.

3. Rifle according to claim 1, characterised in that the sleeve (4) is provided with a radially projecting fastening ridge (9) on the side opposite the mounting rail (5), which can be locked in the shell (2).

* * * * *

UNITED STATES PATENT AND TRADEMARK OFFICE

CERTIFICATE OF CORRECTION

PATENT NO. : 6,499,246 B1
DATED : December 31, 2002
INVENTOR(S) : U. Zedrosser

It is certified that error appears in the above-identified patent and that said Letters Patent is hereby corrected as shown below:

Title page,
Item [30], the Foreign Priority Data correctly should read:

-- May 29, 1998 (AT) …….. A 925/98 --.

Signed and Sealed this

Twenty-second Day of July, 2003

JAMES E. ROGAN
*Director of the United States Patent and Trademark Office*